US005907876A

United States Patent [19]

Schwabe

[11] Patent Number: 5,907,876

[45] Date of Patent: Jun. 1, 1999

[54] PORTABLE PILLOW

[76] Inventor: Janet Schwabe, 5639 N. Menard, Chicago, Ill. 60646

[21] Appl. No.: 09/019,282

[22] Filed: Feb. 5, 1998

[51] Int. Cl.[6] ..... A47G 9/00

[52] U.S. Cl. ..... 5/646; 5/636

[58] Field of Search ..... 5/646, 647, 636, 5/645, 637, 630, 632, 640, 643; D6/601

[56] References Cited

U.S. PATENT DOCUMENTS 2,883,681 4/1959 Caplan ..... 5/636

3,883,906 5/1975 Sumpter ..... 5/646

4,235,472 11/1980 Sparks et al. ..... 5/646

5,604,944 2/1997 Meade ..... 5/646

*Primary Examiner*—Alex Grosz

[57] ABSTRACT

A pillow is provided including an exterior extent defining an interior space and a pair of open ends. A pair of interior extents are included each having a hollow tubular configuration. Each interior extent has a length equal to that of the exterior extent and is situated within the interior space of the exterior extent in parallel relationship.

6 Claims, 2 Drawing Sheets

PORTABLE PILLOW

BACKGROUND OF THE INVENTION

1. Field of the Invention

The present invention relates to pillows and more particularly pertains to a new portable pillow for allowing a user to comfortably rest his or her head in awkward and cramped areas.

2. Description of the Prior Art

The use of pillows is known in the prior art. More specifically, pillows heretofore devised and utilized are known to consist basically of familiar, expected and obvious structural configurations, notwithstanding the myriad of designs encompassed by the crowded prior art which have been developed for the fulfillment of countless objectives and requirements.

Known prior art pillows include U.S. Pat. No. 5,239,717; U.S. Pat. No. 4,683,601; U.S. Pat. No. 4,270,235; U.S. Pat. No. 5,214,814; U.S. Patent Des. 331,520; and U.S. Patent Des. 318,923.

In these respects, the portable pillow according to the present invention substantially departs from the conventional concepts and designs of the prior art, and in so doing provides an apparatus primarily developed for the purpose of allowing a user to comfortably rest his or her head in awkward and cramped areas.

SUMMARY OF THE INVENTION

In view of the foregoing disadvantages inherent in the known types of pillows now present in the prior art, the present invention provides a new portable pillow construction wherein the same can be utilized for allowing a user to comfortably rest his or her head in awkward and cramped areas.

The general purpose of the present invention, which will be described subsequently in greater detail, is to provide a new portable pillow apparatus and method which has many of the advantages of the pillows mentioned heretofore and many novel features that result in a new portable pillow which is not anticipated, rendered obvious, suggested, or even implied by any of the prior art pillows, either alone or in any combination thereof.

To attain this, the present invention generally comprises an exterior extent having a square planar top portion, a square planar bottom portion, and a pair of side portions integrally coupled between the top and bottom portion along a length thereof. As such, an interior space and a pair of open ends are defined. The side portions define a portion of a tube with an oval cross-section. Further, the exterior extent has a common thickness along an entire extent thereof. Associated therewith is a pair of interior extents each having a hollow tubular configuration and an oval cross-section. Each interior extent has a length equal to that of the side portions of the exterior extent and a common thickness along an entire extent thereof. Each interior extent is further situated within the interior space of the exterior extent in parallel relationship. It should be noted that an outer half of an outer surface of each interior extent is integrally coupled along an interior surface of an associated one of the side portions of the exterior extent. In addition, an inner half of the outer surface of each interior extent are integrally coupled to define a pair of spaces situated along a central extent of the top and bottom faces of the exterior extent. Each of such spaces has a generally triangular cross-section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable pillow apparatus and method which has many of the advantages of the pillows mentioned heretofore and many novel features that result in a new portable pillow which is not anticipated, rendered obvious, suggested, or even implied by any of the prior art pillows, either alone or in any combination thereof.

It is another object of the present invention to provide a new portable pillow which may be easily and efficiently manufactured and marketed.

It is a further object of the present invention to provide a new portable pillow which is of a durable and reliable construction.

An even further object of the present invention is to provide a new portable pillow which is susceptible of a low cost of manufacture with regard to both materials and labor, and which accordingly is then susceptible of low prices of sale to the consuming public, thereby making such portable pillow economically available to the buying public.

Still yet another object of the present invention is to provide a new portable pillow which provides in the apparatuses and methods of the prior art some of the advantages thereof, while simultaneously overcoming some of the disadvantages normally associated therewith.

Still another object of the present invention is to provide a new portable pillow for allowing a user to comfortably rest his or her head in awkward and cramped areas.

Even still another object of the present invention is to provide a new portable pillow that includes an exterior extent defining an interior space and a pair of open ends. A pair of interior extents are included each having a hollow tubular configuration. Each interior extent has a length equal to that of the exterior extent and is situated within the interior space of the exterior extent in parallel relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
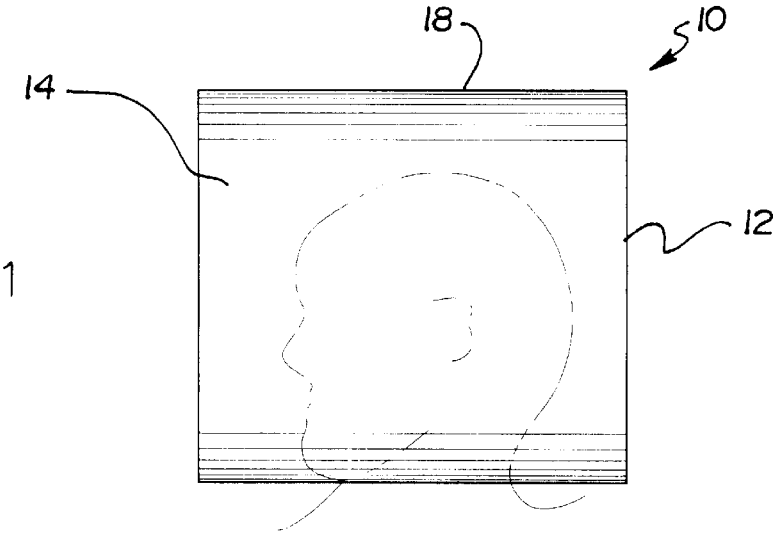
FIG. 1 is a top view of a new portable pillow according to the present invention.
Figure 2:
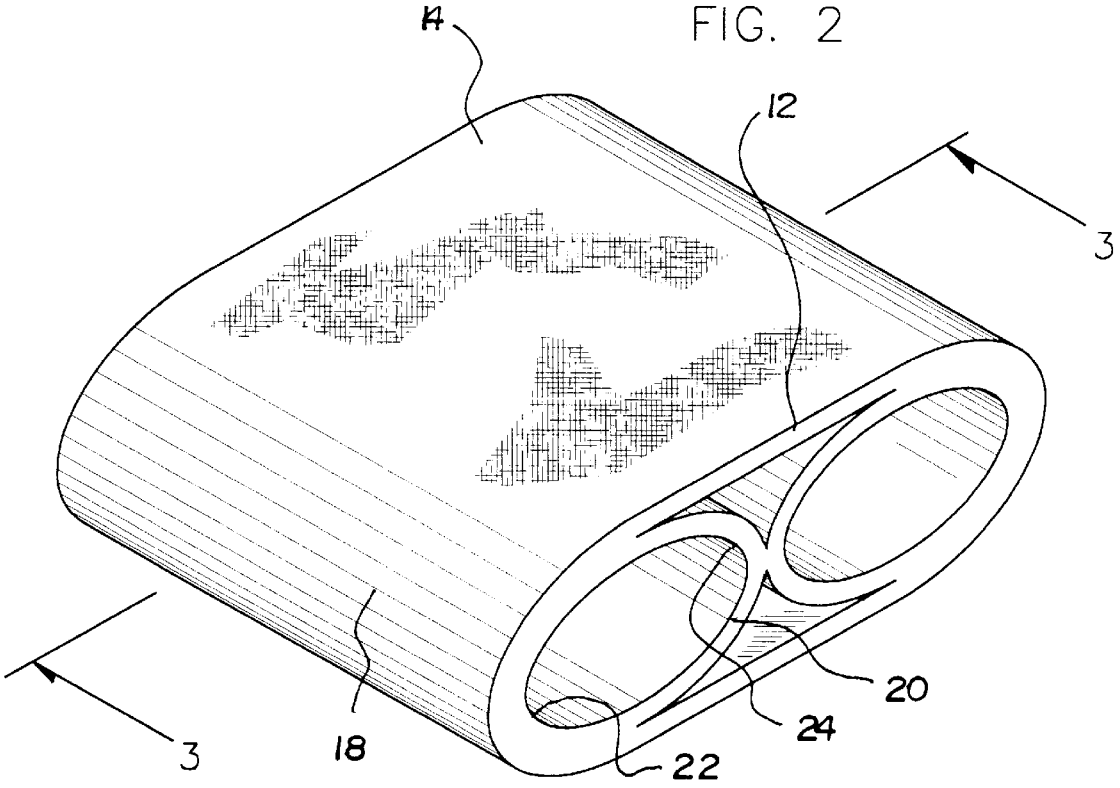
FIG. 2 is a perspective view of the present invention.
Figure 3:
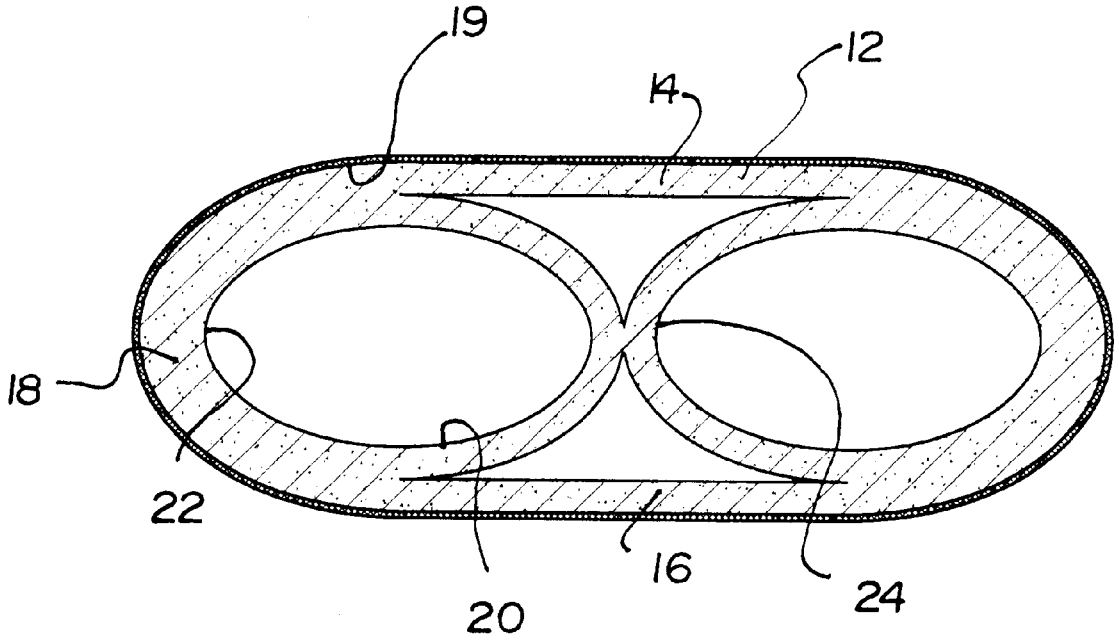
FIG. 3 is a cross-sectional view of the present invention taken along line 3—3 shown in FIG. 2.

With reference now to the drawings, and in particular to FIGS. 1 through 3 thereof, a new portable pillow embodying the principles and concepts of the present invention and generally designated by the reference numeral 10 will be described.

The present invention, as designated as numeral 10, includes an exterior extent 12 having a square planar top portion 14, a square planar bottom portion 16, and a pair of side portions 18 integrally coupled between the top and bottom portion along a length thereof. As such, an interior space and a pair of open ends are defined. The side portions ideally define a portion of a tube with an oval cross-section. Further, the exterior extent has a common thickness along an entire extent thereof. For reasons that will become apparent hereinafter, the outer surface of the exterior extent may be covered with a cotton lining 19. Preferably, the pillow is 9 inches wide and 13 inches long.

Associated therewith is a pair of interior extents 20 each having a hollow tubular configuration and an oval cross-section. The interior extents each define a pair of open ends. Each interior extent has a length equal to that of the side portions of the exterior extent and a common thickness along an entire extent thereof. Each interior extent is further situated within the interior space of the exterior extent in parallel relationship. In such orientation, the foci of a cross-section of the tubes are in linear alignment.

It should be noted that an outer half 22 of an outer surface of each interior extent is integrally coupled along an interior surface of an associated one of the side portions of the exterior extent. In addition, an inner half 24 of the outer surface of both interior extents are integrally coupled to define a pair of spaces situated along a central extent of the top and bottom faces of the exterior extent. Each of such spaces has a generally triangular cross-section. In the preferred embodiment, the exterior and interior extents are both formed of a unitary piece of foam.

During use, hands of a user are situated within opposite ends of respective interior extents such that a head of the user may be rested on the top portion of the exterior extent. As an option, the ends of the interior extents may be equipped with an elastic covering for encompassing an arm when the hands of the user are inserted within the interior extents. As such, a suitable place for resting a user's head is provided irrespective of the current location of the user. The present invention is ideally suited for being used in a truck, at a desk, or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pillow comprising, in combination:

an exterior extent having a square planar top portion, a square planar bottom portion, and a pair of side portions integrally coupled between the top and bottom portion along a length thereof for defining an interior space and a pair of open ends, wherein the side portions define a portion of a tube with an oval cross-section and the exterior extent has a common thickness along an entire extent thereof;

a pair of interior extents each having a hollow tubular configuration with an oval cross-section, each interior extent having a length equal to that of the side portions of the exterior extent and a common thickness along an entire extent thereof, each interior extent situated within the interior space of the exterior extent in parallel relationship such that an outer half of an outer surface thereof is integrally coupled along an interior surface of an associated one of the side portions of the exterior extent and further an inner half of the outer surface of each interior extent integrally coupled to define a pair of spaces situated along a central extent of the top and bottom faces of the exterior extent, wherein each space has a generally triangular cross-section;

whereby hands of a user are situated within opposite ends of respective interior extents such that a head may be rest on the top portion of the exterior extent.

2. A pillow comprising:

an exterior extent defining an interior space and a pair of open ends; and a pair of interior extents each having a hollow tubular configuration, each interior extent situated within the interior space of the exterior extent in a generally parallel relationship, wherein hands of a user can be situated within open ends of the interior extents;

wherein an outer half of an outer surface of the interior extents is integrally coupled along an interior surface of an associated one of two side portions of the exterior extent and further an inner half of the outer surface of each interior extent defines a pair of spaces situated along a central extent of top and bottom portions of the exterior extent.

3. A pillow a set forth in claim 2 wherein the interior extents have an oval cross-section.

4. A pillow as set forth in claim 2 wherein the exterior extent has a square planar top portion, a square planar bottom portion, and a pair of side portions integrally coupled between the top and bottom portion along a length thereof, wherein the side portions each define a portion of a tube.

5. A pillow as set forth in claim 2 wherein the exterior extent and interior extents are unitary.

6. A pillow comprising:

an exterior extent defining an interior space and a pair of open ends; and a pair of interior extents each having a hollow tubular configuration, each interior extent situated within the interior space of the exterior extent in a generally parallel relationship, wherein hands of a user can be situated within open ends of the interior extents;

wherein the exterior extent has a square planar top portion, a square planar bottom portion, and a pair of side portions integrally coupled between the top and bottom portion along a length thereof, wherein the side portions each define a portion of a tube.

* * * * *